United States Patent [19]

Witzel

[11] 4,019,737

[45] Apr. 26, 1977

[54] FOOTBALL GAME BOARD

[76] Inventor: William L. Witzel, 13914 Shannon Drive, Silver Spring, Md. 20904

[22] Filed: Nov. 17, 1972

[21] Appl. No.: 307,495

[52] U.S. Cl. ..... 273/94 R; 273/134 CF

[51] Int. Cl.[2] ..... A63F 3/00

[58] Field of Search ..... 273/87 G, 88, 93 R, 273/94 R, 130 H, 134 ES, 134 CF, 134 GM, 136 C; 116/120

[56] References Cited

UNITED STATES PATENTS

| | | | |
|---|---|---|---|
| 751,473 | 2/1904 | Dennis | 273/134 ES X |
| 1,592,877 | 7/1926 | Weston | 273/93 R X |
| 1,694,965 | 12/1928 | Buckley | 116/120 X |
| 1,706,646 | 3/1929 | Auer | 116/120 |
| 1,838,398 | 12/1931 | Heidbrink | 273/134 CF |
| 1,859,982 | 5/1932 | Pangratz et al. | 116/120 |
| 1,870,515 | 8/1932 | Kotlarz | 116/120 |
| 2,164,466 | 7/1939 | Montgomery | 273/94 R X |
| 2,371,575 | 3/1945 | Trimble | 273/136 C |
| 2,579,105 | 12/1951 | Baldine | 116/120 X |
| 2,866,601 | 12/1958 | Naber | 273/148 R UX |
| 3,423,090 | 1/1969 | Pfund | 273/94 R |
| 3,499,646 | 3/1970 | Burgess, Jr. et al. | 273/1 R |

*Primary Examiner*—Richard C. Pinkham
*Assistant Examiner*—Harry G. Strappello

[57] ABSTRACT

A game apparatus comprising a game board having a substantially flat upper surface with a quarter score point differential indicator of a football game placed on the upper surface. A game point selector is placed on the upper surface and comprises an indicator mounted to the board, and a down and distance character zone placed on the board, each down and distance character zone being correlated to the quarter score point differential indicator of the football game, and containing down and distance characters representing the down of a football game and the yards needed to obtain a first down for the down. A run and pass character zone with associated numerical values is placed on the board surface, the indicator being adapted to be moved in a direction corresponding to the particular down and distance needed for a first down of a football game to designate a numerical value for a selection of a particular run and pass character, the designated numerical value accounting for the scoring of the game apparatus.

25 Claims, 5 Drawing Figures

Goal
Line
Time
12
14
16
18
20
22
24
25
28
30
32
74
112
114
116
118
3'

FOOTBALL GAME BOARD

BACKGROUND OF THE INVENTION

The present invention generally relates to an amusement game and more particularly to a game designed to allow the player to utilize his or her own play calling ability during an actual football game in comparison with the actual play which is called and executed by the quarterback.

It is, therefore, a primary purpose of the present invention to provide a new and improved amusement apparauts which permits an exercise of judgment and prediction not previously found in football games which are presently on the market. The game presents the players a chance to score themselves on the play actually executed with the score being determined by variable factors which enhance the enjoyment of play.

The game has been designed to focus the split-second pressures of play calling upon the players, in order to create total involvement with the football game being viewed. In order to insure this involvement the point values of the game have been established to automatically reflect a relationship between the quarter of the game, the score of the game, the down, distance to a first down, field position and time remaining factors. These factors are the same ones considered by professional and college quarterbacks before they call their plays.

SUMMARY OF THE INVENTION

The football game invention includes a playing board having at least one rotatable selector disc mounted thereon so that the disc aligns values printed on the game board based on the quarter, score, down, distance and whether a pass or run has been executed to arrive at a scoring value.

BRIEF DESCRIPTION OF THE DRAWINGS

The scoring values is then recorded on the game board. Other features and advantages of the invention will be apparent from the following description of the embodiments of the invention as shown in the accompanying drawings.

DETAILED DESCRIPTION OF THE EMBODIMENTS

Figure 1:
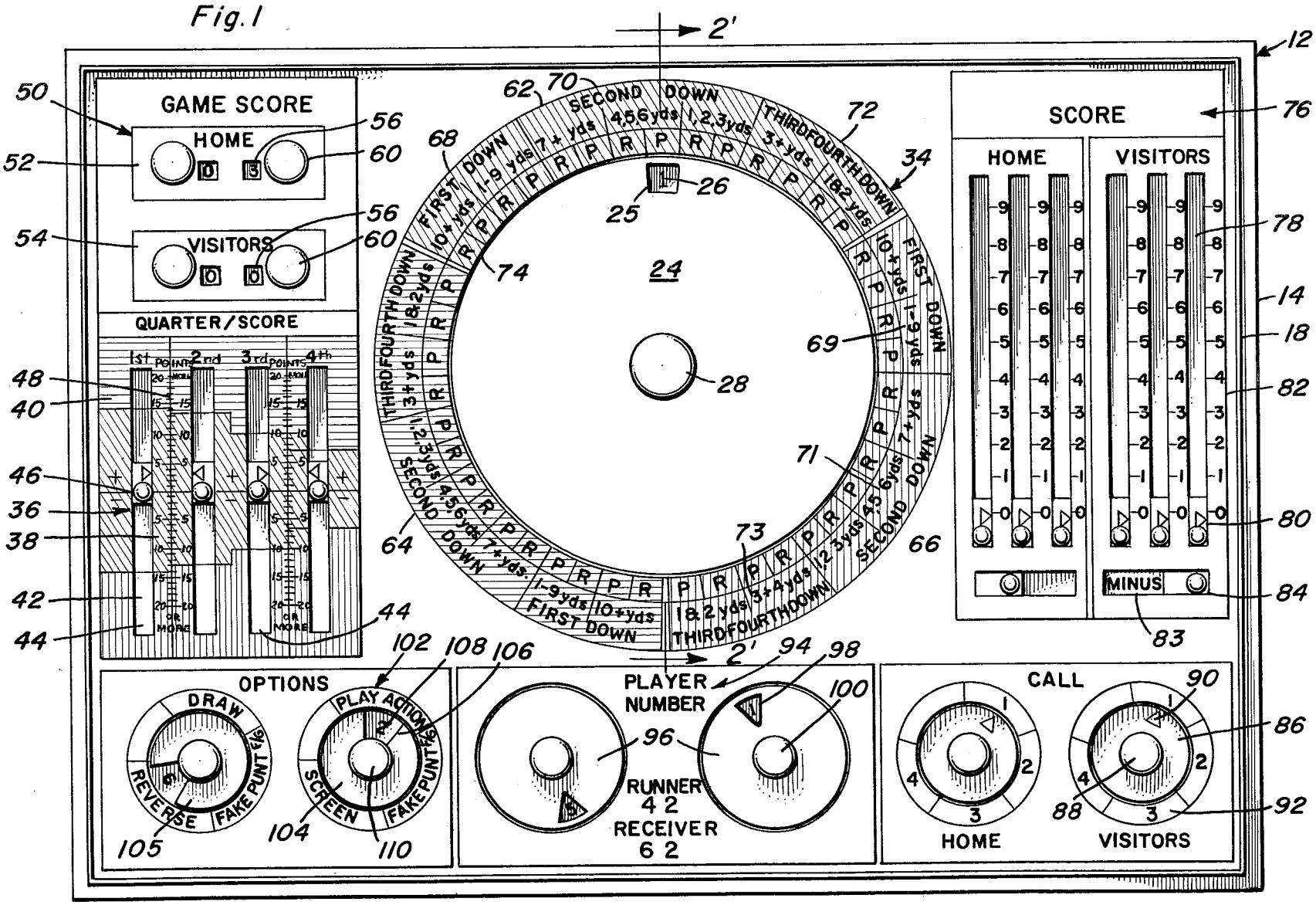
FIG. 1 is a plan view of the football game board according to the invention.

With reference to the figures, the apparatus of the football game apparatus comprises a game board 12 of a suitable rigid, durable material such as a cardboard, metal, plastic or the like. The game board 12 comprises a base 14 and a substantially planar top 16 supported by a plurality of walls 18. The planar surface 16 preferably defines a recess 20 which is adapted to hold a plurality of scoring discs. If desired a foldable stand (not shown) may be attached to the base 14 to assist in supporting the game board 12 substantially upright to allow the players to see the face of the board.

Figures 2, 3, 4, 5:
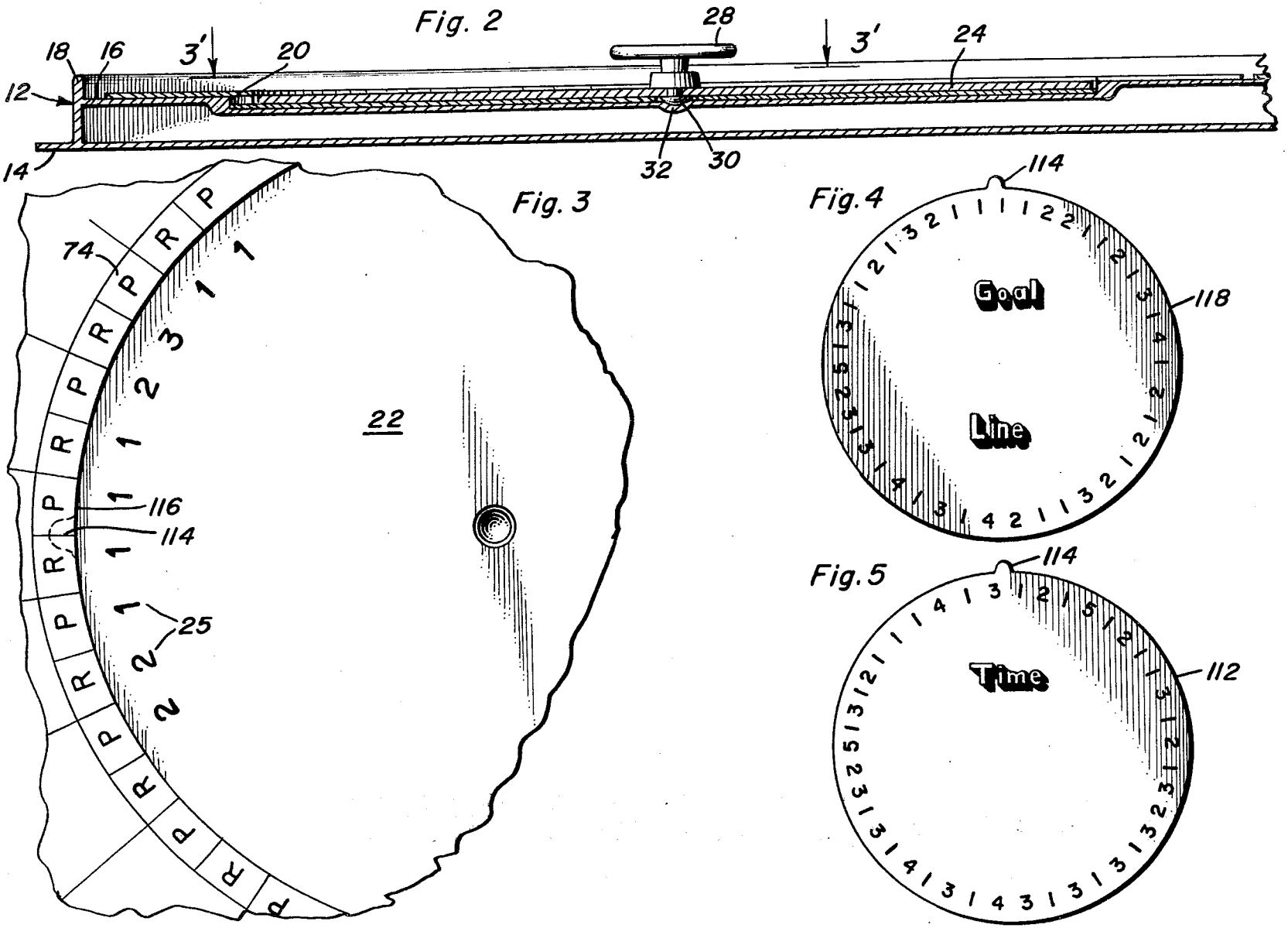
FIG. 2 is an enlarged cross section of the game board taken along line 2′—2′ of FIG. 1.
FIG. 3 is a partial plan view taken along lines 3′—3′ of FIG. 2 with the selector disc removed showing a scoring disc inserted in the game board recess.
FIG. 4 is a plan view of a goal line scoring disc which can be inserted in the game board recess.
FIG. 5 is a plan view of a scoring time disc which can be inserted in the game board recess.

In the preferred embodiment circularly arranged scoring indicia 25 are printed on the surface 21 of the circular recess 20. In an alternate embodiment, a scoring disc 22 rests within the circular recess 20 and is kept in place by a tab 114 which fits into a tab receiving slot 116 as shown in FIG. 3 The tab 114 and slot 116 serve to orient the scoring disc in proper position and prevent rotation within the recess 20 when the selector disc 24 is rotated as described below. The scoring disc 22 and recess surface 21 carry on their faces a plurality of characters arranged as a circular row of figures 25 as is shown in FIG. 3. The characters represent the probability of a particular run or pass occuring in relation to a down and distance factor and to the time and score of the game. The designating characters which are Arabic numerals may be affixed to the recess surface or disc in any suitable manner as for example by printing. The disc 22 can be made of various materials suitable for insertion into the recess 20 in the form of sheets of cardboard, metal, plastic or similar material.

Rotatably mounted in the recess 20 over the recess surface 21 is a generally circular selector disc 24 which has a scoring window 26 cut therein so that at least one of the numerals 25 of the recess surface 21 positioned beneath the selector disc 24 can be read. The selector disc 24 is preferably made of opaque material so that all of the figures 25 are cut off from view except the figure framed by the window 26. The selector disc 24 is rotated by handle 28 which extends through selector disc 24 and is adapted to be removed from the game board recess 20. The handle 28 preferably has a riveted means 30 or other suitable means used to connected it to the selector disc 24. If desired the turning handle 28 can be integrally molded with the selector disc 24 if the same is made of plastic or the handle can be secured to the disc by adhesive or other suitable means. When a rivet means 30 or other type of handle holding means is utilized which extends past the cover, the extension is inserted into a depression 32 formed in the surface 21 of the recess 20. However, the selector disc 24 can be rotatably connected to the recess surface 21 by any suitable means which will allow rotation of the selector disc. In order that the handle can be more easily turned thus rotating the selector disc, serrations are preferably formed in the handle surface so that it can be more easily gripped. Printed around the recess 20 is a circular character zone 74 divided into alternating segmented run and pass indicating letters. A second circular row of scoring indicia 34 spaced radially outwardly from the first circular character zone 74 includes characters indicating a down and distance situation.

Positioned on one side of the board is a delineated master indicator selector 36 which is color coordinated to correspond the sectional coloring of the scoring indicia 34. The master indicator selector 36 comprises a home-visitor positive-negative defined score range 38 which for example can be color coordinated with the color green, a home-visitor positive defined score range 40 color coordinated with the color blue and a home-visitor negative defined score range 42 color coordinated with the color orange. Positioned within the master indicator selector 36 are a plurality of channels 44 each of which preferably has a quarter/score indicator 46 slidably mounted therein. The quarter/score indicators 46 are slidably mounted so that they can point to the scoring range indicia 48 positioned adjacent the channels. The game preferably has four channels 44, one for each of the four quarters in the football game with each channel being marked by a figure indicating the quarter. In alternate embodiments of the master indicator selector a pegboard is substituted for the channels and the indicators are pegs which are placed in holes in the appropriate position on the master indicator selector or if a metal board is substituted for the channels, magnetic discs or squared (or other geometrically designed pointers) are placed in the appropriate position on the master indicator selector.

The indicia 34 printed around the recess 20, character zone 74 are preferably broken down into three sections which are color coded to facilitate immediate correlation with the master indicator selector 36. The three sections comprise a home-visitor, negative-positive indicia section 62 colored green which corresonds to the master indicator selector section 38, a home-visitor positive indicia section 64 colored blue which corresonds to the master indicator selector segment 40 and a home-visitor negative indicia section 66 colored orange which corresponds to the master indicator selector 42. Each of the board scoring indicia sections are broken down into a first down segment 68, a second down segment 70, and a third and fourth down segment 72. The first down segment 68, second down segment 70 and third and fourth down segment 72 respectively contain characters 69, 71, and 73 representing yard distnce portions as well as the down, each of which has alternating columns of run-pass indicators in the zone 74 positioned adjacent thereto. This arrangement of indicia 34 and character zone 74 allows the player to play the game by turning the window 26 according to the down and yardage situation to either a run or pass situation.

A football game scoreboard 50 is located on the game board showing home team score 52 and the visitor score 54. A plurality of windows 56 are cut in the game board so that the respective scores can be set up in the windows by turning a plurality of dials (not shown) having circumferentially arranged numbers 56. The dials are rotatably mounted in the game board and are turned by the knobs 60 so that the desired figures indicating the correct score will be visible through the windows 56. Alternatively, a pegboard and pegs or magnetic board with magnetic indicators can be used in place of the dials to show the football game score.

In an alternative embodiment of the invention the scoring indicia 34, character zone 74, and numerals 25 can be printed on a single disc or overlay. This disc or overlay can be removably mounted to the game board and secured to the game board in such a manner that when the selector disc is mounted thereupon and rotated an indentical reading or scoring as that used with the preferred embodiment can be obtained. In yet another variation a rotatable pointer is invisualized as being used in place of the selector disc. Still other variations encompass the use of a peg-board and pegs or a magnetic board with magnetic indicators in place of the selector disc or rotatable pointer.

A player scoring tally 76 is positioned on the game board with a plurality of channels 78 cut therein, each of which holds a slidable score marking indicator 80. Preferably six channels are used, three for each player or team with one channel being used to designate unit integers, the middle channel designating the tens integers and the third channel designating the hundreds integer. The score marker 80 can be appropriately moved to record the points scored by each player by moving it opposite the appropriate FIG. 82 printed on the side of each channel 78. The capability of minus scoring in the game is provided by a channel 83 and slidable cover 84 which can be moved to cover or expose the word minus or appropriate symbol therefore. In alternate embodiments of the invention a pegboard or magnetic board can be substituted for the player scoring tally in the same manner as previously discussed for the master indicator selector.

It is possible for a player to have a total minus score because of an accumulation of penalty points for incorrect calls. When this condition occurs, the minus indicator 84 is slid to the minus score position and kept there until the total score becomes plus again.

The game can be made more complex by the use of a wild card type of arrangement on the game so that particular play points can be multiplied. This wild card type of arrangement is designated on the game as the audible section of the game and comprises a plurality of audible selector discs 86 which are rotatably mounted in the game board so that the handle 88 of the discs can be turned allowing a designating marker 90 which is carried or printed on the discs to point to marking indicia 92 printed on the board. In this manner, the option of doubling the players score for a particular play and adding an additional scoring type of situation is accomplished.

If desired a rotating spinner can be substituted for the disc to point to the point multiplying option. While the preferred embodiment uses four options to increase the score any desired number of options can be utilized. Also a pegboard arrangment or magnetic board can be used in place of the rotating disc or spinner if such is desired.

An additional scoring variant is provided in the invention by allowing additional points for guessing the player number carrying or receiving the ball. The player number section 94 has a plurality of rotatably mounted player number selector discs 96 mounted in the game board, each of which has a window pie shaped section 98 or other suitable geometric shape cut therein to expose numbers ranging from 0 – 9 which are printed circularly on the game board. Handles 100 are used to turn the discs 98 so that the individual player number can be determined. Instructional indicia may be provided on the player number section 94 to indicate the scoring values received if a runner or receiver is correctly or incorrectly picked. In alternate embodiments, a rotating spinner, pegboard arrangement, or magnetic board can be substituted for the player designation discs.

Still more points can be accumulated by placing the option section 102 of the invention. The option section 102 is provided on the game board so that specific running or passing situations can be anticipated by the player thus allowing the player to make additional points. In the option section 102 a plurality of discs 104 and 105 are rotatably mounted in the game board, each of the discs having a window or notch 106 which allows numbers 108 printed on the game board to be read. As the handle 110 which is connected to disc 104 or 105 is rotated the notch 106 turns to the particular type pass or run which the player feels will be called by the quarterback. As previously mentioned a spinner, pegboard or magnetic board can be substituted for the disc used in the preferred embodiment.

In addition to the game scoring indicia 25 printed on the floor of recess 20, a goal line scoring disc 110 and a time scoring disc 112 can be inserted into the recess 20 when the appropriate goal line situation and/or time situation occurs. The goal line scoring disc 110, time scoring disc 112, and the scoring disc 22 when used all have tabs 114 as shown in FIGS. 3–5 so that the discs can be inserted in the recess 20 and held in place in an appropriate notch 116 in the recess as shown in FIG. 3.

OBJECT OF THE GAME

The game is played by watching a professional or college football game or other football game on television or listening to the game on radio. The object of the game is to correctly predict each play selected by the quarterback before each play is executed. Plays are entered on the game board through the various score discs for each play. Points are earned for the correct prediction of the play and the player or team of players with the highest number of points wins. The game can be played by a single player, two players or two teams of players who have an understanding of the football rules and basic definitions of the rules of football.

SETTING UP THE GAME

In playing the game before the kick off one player chooses to predict the offensive plays of the home team and the other predicts the offensive plays of the visitor team. Initially, the game score is set up with 0 for the home team and 0 for the visitors on the game board scoreboard. As an example, assume the home team kicks off to the visitors and the ball is returned to the home team's 48 yard line, so that there is a first down and 10 yards to go with the score 0 to 0.

The player who will be selecting the plays of the visitors places the quarter/score indicator 46 on the center line at the even or lined position under first quarter to show that his team is neither ahead nor behind in points.

PLAYING THE GAME

Since the quarter score indicator 46 has been positioned in the green area on the center line of the positive-negative score range 38, the player will be using the green colored negative-positive indicia segment 62 when the selector disc 24 is rotated to call the plays. Before the actual snap of the ball on the television game, the player must call run or pass for every play by rotating the selector disc 24 until the scoring window 26 is adjacent the run or pass segment 74 of the correct down and distance characters of negative-positive indicia segment 62 so that a specific FIG. 25 of the scoring disc 22 is viewed. For example, suppose the guess is run; the player selects run by turning the selector disc 24 to the R position under first down and 10+ yards, and the value 2 appears in the window 26. If the television quarterback actually calls a run, the player moves the counter or indicator 80 under visitors in the scoreboard 76 to position 2, recording his points for a correct prediction. In continuing the example, assume that the running play gained 4 yards, so it is now second down and 6 yards for a first down. The player now predicts a pass by turning the selector disc 24 to the P position under second down and 4, 5, 6 yards, and the value 1 appears in the window 26. This time, the television quarterback calls a run, so the player receives no points.

The player continues to select run or pass, according to each down and distance situation, until the home team gets the ball. At that point the other player (or team of players) takes the game board, places the quarter/score indicator 36 at the position which shows how many points his team (home in our example) is ahead (+) or behind (−) which position also falls within a color which is coordinated to the various section colors of the scoring indicia 34. He or she then proceeds to call run or pass for each play using the selector 24 with either the color coordinated positive segment 64, negative segment 66 or negative-positive segment 62.

Additional points can be scored when in addition to the player selecting run or pass, the player selects the type of run or pass by using the option section 102. For example, the player may call a draw play by first turning the selector disc 24 to a R (run) setting under the proper down and distance segment, and then turning the run option selector disc 105 to draw. If the play is really a draw the player receives points for selecting the run, plus extra points for selecting the draw. If the play is a run, but not a draw, the player earns the run points shown in the selector disc window 26 minus points for incorrectly selecting the draw. In the play is not a run at all, the player just loses 2 points for the incorrect draw call.

The player can select the type of pass play in the same manner, by using the pass option selector disc 104.

Optional selections are made by the player only when he or she thinks the particular type of run or pass is going to be called by the quarterback, and need not be made for every play.

In another variation of the game the players predict the jersey number of the runner for a running play, or the jersey number of the receiver for a passing play. The player number selector discs 96 are used for these calls. Correct runner selections earn 4 points and incorrect selections lose 2 points. Correct receiver selections earn 6 points and incorrect calls lose 2 points. These points are scored in addition to or minus the points for calling the run or pass correctly. When predicting the receiver, the player selects the jersey number of the offensive end or back for whom a pass is intended, whether or not the pass is completed. If a pass is deflected or intercepted by a lineman, no receiver is recognized for that play; the play is scored as a pass, but no points are either awarded or subtracted if a receiver has been selected by a player. In like manner, if a pass is deflected, or if an interception occurs by a linebacker or defensive back in an area occupied by two or more potential receivers, no receiver is recognized for that play. However, if a deflection or interception by a linebacker or defensive back occurs, but the intended receiver is clearly apparent, points are awarded for a correct receiver number, or subtracted for an incorrect receiver number.

When predicting the runner, the player selects the jersey number of the offensive back for whom the running play is designed. If this runner fumbles the ball, and a second back recovers and runs with the ball, the first back is still designated as the runner for scoring purposes.

It is evident that any combination or selections of the various play selections can be used in the game and that any combination of the variation can be used to effectively play the game. Regardless of the particular variations used each player (or team of players) can make four audible play calls during the game. These calls are made before the snap of the ball, using audible selector disc 86. An audible call doubles the total net points awarded for a particular play. For example, if a correct run or pass call would result in 2 points, and an audible selection was used by a player, a total of 4 points would result from the play. If an incorrect run/pass selection was made with an audible call, no points would be earned, but the player would have used up one of his 4 audible calls.

If an incorrect audible selection was made under the play options or player number option, the player could find he or she had doubled a minus net score. In effect, the audible call selection gives the player the chance to get double points on a correct prediction, but also increases the risk of losing double points on an incorrect prediction.

Audible calls not used by the end of the game are lost to the player (or team of players).

Whenever the football game gets into a "goal line" or "time" situation the goal line disc 118 or time discs 112 are placed in position in the recess 20 under the selector disc 24. The discs 118 and 112 have different run and pass values than the game values of recess face 21 or disc 22 due to the different circumstances of play.

A goal line situation covers all plays executed by the offensive team within its opponents 10 yard line.

A time situation covers all plays executed within 2 minutes or less before the end of the second or fourth quarters. In the game time situations always takes precedence over goal line situations. The players may mutually agree before the start of the game to a different definition of time. For example, time may be designated if one football beam is behind 20 or more points with 6 minutes to go in the fourth quarter.

The players must decide who will act as referee for the game. If there are 2 players, one can act as referee for the first and third quarters, with the other officiating for the second and fourth quarters, or third party non-players may be selected referee for the entire game. The referee is the final judge in determining the exact down and distance; the type of play executed (draw, reverse, screen, play action, etc.) the runner or receiver, and whether or not the play was selected prior to the snap of the football.

Each player must select or call the play before the snap of the football. If he fails to do so, his calls for that play are voided, and he scores no points, regardless of the outcome.

"No play" is called by the referee if a play is not executed to the point where it can be determined if it is a run or pass, such as a fumble of the center snap or a penalty called as the play begins. If a play is completed and then a penalty called, it is scored as executed. The penalty has no bearing on scoring, only the correctness of the prediction.

The game offers countless opportunities to vary the playing rules, depending upon the number of players, football knowledge and composition of teams.

While the preferred embodiment of the invention has been disclosed, it is understood that the invention is not limited to such an embodiment since it may be otherwise embodied in the scope of the appended claims.

What is claimed is:

1. A game apparatus comprising a game board having a substantially flat upper surface, means to indicate the quarter score point differential between two opposing teams of a football game placed on said upper surface, said point differential score means being divided into a plurality of scoring zones, a game point selection means comprising a second indicator means mounted to said board, a plurality of segmented down and distance character indicia zones placed on said board opposite said second indicator means, each said down and distance character indicia zone containing down and distance characters representing the down of a football game and the yards needed to obtain a first down for said down and being correlated to one of said point differential scoring zones, a run and pass character indicia zone with associated indicia including numerical values placed on said board surface adjacent to and aligned with said down and distance zone, said second indictor means being adapted to be moved to designate that segment of said down and distance character indicia zone corresponding to the particular down and distance needed for a first down in a football game which is correlated to the point differential score means scoring zone indicated by the first indicator means, while simultaneously designating a numerical value for a selection of a football play, said designated numerical value accounting for the scoring of the game when the correct football play is selected.

2. A game apparatus as claimed in claim 1 wherein a plurality of zones differentiated by different colors are placed on said game board surface trnsverse to said quarter score differential means and a plurality of segmented identically colored segment down and distance character indicia zones are placed on said board, the positioning of said quarter score differential means falling on one of said colored zones determining the color of the segmented down and distance character indicia zone at which said game point selection means will be positioned.

3. A game apparatus comprising a game board having a substantially flat upper surface, a quarter score indicating means positioned on said substantially flat upper surface, said quarter score indicating means comprising a plurality of football game score point differential zones each of which has a separate identifying marking, said plurality of football game score point differential zones being divided into game quarter sections, at least one row of scoring indicia placed on said surface in relation to said game quarter sections and a pointer member connected to said board, said pointer member being adapted to indicate a game score point differential zone, a point scoring means positioned on said substantially flat upper surface, said point scoring means comprising a scoring numeral section, having a plurality of numbers positioned thereon, at least one run and pass character indicia section positioned in alignment to said scoring numeral section, a segmented down and distance character section positioned in alignment to said run and pass character indicia section, each segment of said down and distance character section having an identifying marking identical to one of the football game score point differential zones, and movable indicator means mounted to said game board surface, said movable indicator means being adapted to indicate at least one numeral of said scoring numeral section when aligned with one character of said run and pass character indicia section and a segment of said down and distance character section which is identically marked to that game score point differential zone indicated by the pointer member.

4. A game apparatus as claimed in claim 3 wherein said movable indicator means is a rotatable disc means, said disc means being positioned over the scoring numeral section and having an aperture cut therein for designating at least one of said scoring numerals in said scoring numeral section.

5. A game apparatus as claimed in claim 4 including a player score board, said player score board comprising a plurality of channels cut into said game board and a slidable indicator mounted into each of said channels, at least one of said channels having numerical indicia representing unit integers, at least one of said channels having numerical indicia representing tens integers and at least one of said channels having numerical indicia representing hundreds integers.

6. A game apparatus as claimed in claim 3 wherein said scoring numerical section comprises selected adaptor scoring plate removably mounted to said game surface.

7. A football game adapted to be played with a football game bradcast comprising a game board having a substantially flat upper surface, a plurality of indicator means mounted to said game board, numerical and character indicia associated with each of said indicator means, a first indicator means movably mounted to means for presenting the quarter score differentiation between opposing football tems, said quarter score differentiation means being being divided into four segments representing game quarters, each of said segments being divided into a plurality of identification zones, representing a predetermined score differential between the opposing teams of the broadcast game during the progress of the game, a second indicator means/mounted to a scoring section means defined on said game board, said scoring section means comprising an area marked with down and distance indicia, said down and distance indicia comprising a plurality of segments, each of said segments being matched to only one of said quarter score differentiation means segments identification zones, and representing at least one of four downs and at least one distance needed to obtain a first down, a runpass area having run and pass characters positioned adjacent said down and distance area and a numerical value section, said second indicator means being adapted to always designate varying specific numerical values in said numerical value section when aligned with a character in said run-pass area and that segment of said down and distance area which matches the quarter score segment identification zone presented by said first indicator means to account for the scoring of the game.

8. A football game board as claimed in claim 7 including a player tally section placed on said game board surface, said player tally section comprising a plurality of segments, each segment having numerical indicia placed thereon representing unit integers, tens integers, and hundred integers, and a tally indicator means movably mounted to said segment for designating certain of said numerical indicia to represent a player's tally, said tally indicator means comprising a plurality of channels and a slidable pointer mounted in each of said channels.

9. A football game board as claimed in claim 7 wherein said down and distance area is divided into three sections, each of said sections being color coded and said quarter scoring section area zones are color coded, said down and distance sections being color coded to correspond to a related quarter scoring zone.

10. A football game board as claimed in claim 7 wherein said quarter scoring section areas zones are divided into two zones, one of which represents the point differential that the winning team is ahead and the other representing the point differential that the losing team is behind.

11. A football game board as claimed in claim 7 including a player numerical selection section, said player selection section having numerical indicia placed thereon representing unit integers and tens integers and player indictor means movably mounted on said player selection section to designate predetermined numerical indicia representing the player number.

12. A football game board as claimed in claim 11 wherein said player indicator means comprises at least one rotatable disc, each said disc having a window cut therein so that when said disc is rotated a numerical indicia appears in said window under said disc.

13. A football game board as claimed in claim 7 including a score multiplication section, said score multiplication section having unit integers placed thereon and movable multiplication indicator means adapted to indicate a particular unit integer.

14. A football game board as claimed in claim 13 wherein said multiplication indicator means comprises at least one disc, each said discs having means thereon for selecting one of said unit integers.

15. A football game board as claimed in claim 7 including an option section, said option section including at least one character zone, and a numerical value section, said at least one character zone having running plays and passing plays placed thereon, an option indicator means mounted to said game board to indicate the play selected, said option indicator means being positioned over said numerical value section to indicate a scoring figure.

16. A football game as claimed in claim 7 including a section for recording the game score of the football game being broadcast.

17. A football game adapted to be played in connection with a football broadcast comprising a game board having a generally flat upper surface, said game board defining a recess, scoring means having numerical indicia imprinted thereon positioned in said recess, a circular area of run and pass designation characters surrounding said recess, a down and distance area having down and distance designation characters place on said game board adjacent said run and pass area in a plurality of separate coded sectors, a selector disc rotatably mounted in said recess and defining a window portion dimensioned and positioned to display one numerical value on said scoring means to provide scoring for the game, the rest of said selector discs body blocking all other numerical values on the scoring means from the view of the player when said window is aligned with one of said run and pass characters, a quarter score indicating means placed on said game board upper surface, said quarter score indicating means being adapted to indicate the quarter score differential between two opposing football teams in one of a plurality of zones dividing said quarter score indicating means into areas correspondingly coded to said down and distance area coded sectors.

18. A football game as claimed in claim 17 wherein said down and distance area is divided into a plurality of equal size sectors, and said quarter score indicating means is divided into separate score differential zones, said sectors being equal in number to the number of quarter score differential zones with each of said quarter score differential zones and said down and distance zone sectors having matched coded colors.

19. A football game apparatus as claimed in claim 17 wherein an additional scoring disc is selectively insertable in said recess, said scoring disc defining a tab projection and each recess defining a receiving slot to mate with said tab projection to prevent rotation of said disc when said selector disc is rotated.

20. A game apparatus as claimed in claim 19 wherein said scoring disc is a time disc used when a period of not more than two minutes remain in the game.

21. A game apparatus as claimed in claim 19 wherein said scoring disc is a goal line disc used when one team is within ten yards of an opponent goal line.

22. A football game as claimed in claim 17 wherein the score of broadcast game is indicated by broadcast game score means mounted on said game board.

23. A football game apparatus adapted to be used with a television broadcast of a football game comprising a game board having a substantially flat upper surface, means for setting forth the score differential between opposing football teams placed on said surface, said score differential mens being divided into two sections, one of said sections indicating the number of points the winning team is ahead and the other section indicating the number of points the losing team is behind, each of said sections being divided into a plurality of colored selector locator zones, numerical scoring means placed on said surface, said scoring means comprising a plurality of colored sections designating a down and predetermined distance needed to obtain a first down, each of said colored sections corresponding in color to one of said colored selector locator zones, a play type section positioned adjacent said down and distance sections and a numerical value section positioned opposing said play type section, said numerical scoring means indicating varying scoring values for a selected type of play for a particular team on a designated down with a predetermined distance needed to obtain a first down, selector means mounted on said board over said numerical scoring means for designating a scoring value on said scoring means for a type of play, and designated down and distance section which is the same color as the score differential colored selector locator zone.

24. A football game apparatus as claimed in claim 23 wherein said numerical scoring means is divided into three substantially curved sections, each section comprising a first area having characters representing a down being played and distnce needed to obtain a first down, and a second area having characters representing running and passing plays with a fourth section positioned adjacent said three curved sections and being provided with numerical scoring values.

25. A football game adapted to be played with a football game broadcast comprising a substantially flat game board, means for positively setting forth the score differential between opposing teams placed on said game board in an area divided into different color coded sections, means for indicating the type of play placed on said game board, means for indicating the down on which the play is being run and distance needed to obtain a first down placed on said game board, said down and distance means being color coded in the same color as the score differential means colored sections, a numerical value means placed on said board and pointer means mounted on said board which presents a specific point value when the pointer means is aligned with the type of play means, and a down on which the play is being run and distance needed to obtain a first down which is of the same color as that color coded section representing the score differential between opposing teams.

* * * * *